United States Patent [19]

Duncan et al.

[11] 4,041,689

[45] Aug. 16, 1977

[54] MULTILOBAL POLYESTER YARN

[75] Inventors: Patrick Joseph Duncan, Hendersonville, Tenn.; Francis Edward Scrivener, Jr., Chester, Va.

[73] Assignee: E. I. Du Pont de Nemours and Company, Wilmington, Del.

[21] Appl. No.: 631,127

[22] Filed: Nov. 11, 1975

[51] Int. Cl.[2] ..... D02G 3/02; D02G 1/02

[52] U.S. Cl. ..... 57/140 J; 57/157 TS; 260/75 R; 428/397

[58] Field of Search ..... 57/157 R, 157 TS, 140 R, 57/140 J, 34 HS; 260/75 R, 78 R; 264/167, 168, 177 R, 177 F; 428/362, 369, 397–400

[56] References Cited

U.S. PATENT DOCUMENTS

| | | | |
|---|---|---|---|
| 2,939,201 | 6/1960 | Holland | 57/140 J X |
| 2,959,839 | 11/1960 | Craig | 428/397 |
| 3,156,607 | 11/1964 | Strachan | 428/397 |
| 3,216,186 | 11/1965 | Opfell | 57/140 J |
| 3,287,888 | 11/1966 | Chidgey | 57/34 HS |
| 3,425,893 | 2/1969 | Sims | 428/397 |
| 3,508,390 | 4/1970 | Bagnall et al. | 57/140 J |
| 3,691,749 | 9/1972 | McKay | 57/140 J |

FOREIGN PATENT DOCUMENTS

| | | | |
|---|---|---|---|
| 936,729 | 9/1963 | United Kingdom | |
| 1,033,543 | 6/1966 | United Kingdom | 57/140 J |

*Primary Examiner*—John Petrakes

[57] ABSTRACT

Draw-false-twist texturable polyester yarns are provided which have filaments having 6–10 essentially symmetric lobes of equal length equispaced around the central axis of the filament, a modification ratio of from 1.17 to 1.85 and a denier per filament between 3.8 $R_o$ and a maximum value which is a function of the modification ratio, the number of lobes and the factor $R_o$ which is a nominal draw ratio. Less than 12% of the draw-false-twist textured filaments have flattened cross-sectional peripheries greater than 10 microns in length.

8 Claims, 1 Drawing Figure

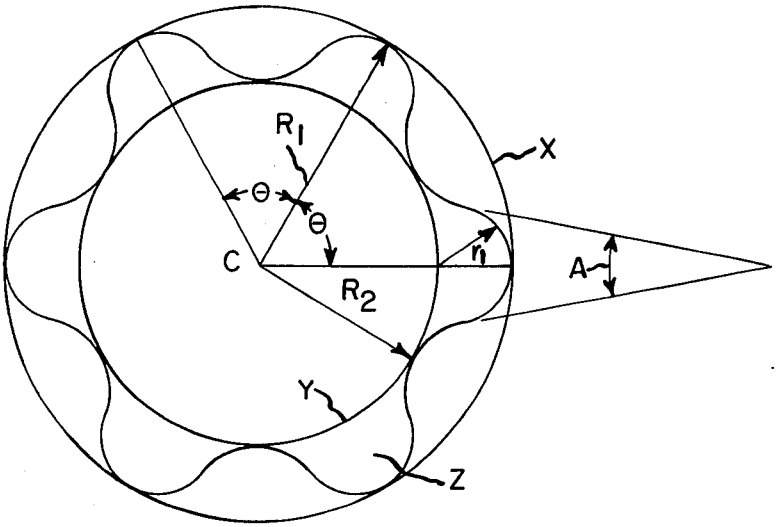
R1
X
Θ
Θ
C
r1
A
R2
Y
Z

MULTILOBAL POLYESTER YARN

BACKGROUND OF THE INVENTION

The invention relates to false-twist textured yarns made from continuous filaments having modified cross-sections, and is more particularly concerned with polyester yarns that can be draw-false-twist textured for use in fabrics having improved visual aesthetics.

Apparel fabrics knitted or woven from continuous filament synthetic yarns are finding increasing acceptance in the trade. However, texturing is needed to eliminate the undesirable slickness of fabrics made from synthetic filaments. Fabric aethetics can be further improved by using fibers having a modified (i.e., non-round) cross-section which leads to higher bulk, a crisper and drier hand, better cover and a pleasing subdued luster.

A variety of methods is used to texture filaments depending on the use of the yarn. One which has met with considerable commercial success is false-twist texturing. Unfortunately, fabrics produced from false-twist textured yarns often have an undesirable glitter or sparkle, i.e., reflection of light in intense beams from tiny areas of the fabric. Except for certain nolvelty applications, this glitter is highly objectionable and detracts from the appearance of the fabric, particularly when the fabric is dyed in dark shades. The propensity to glitter results from yarn changes induced during the false-twist texturing process. In this process, the yarn is twisted, heat-set in the twisted configuration and then untwisted as it exists from the spindle or twist insertion device. The twist-set yarn has a tendency to resume its twisted shape, thus causing the filaments to become crimped and looped, thereby creating bulk and elasticity In the yarn. Under the conditions normally used to false-twist texture yarns, i.e., high twist levels and temperatures above the softening point, the individual filaments in the twisted hot yarn become distorted and tend to form flat surfaces that reflect light in intense beams. Such reflectance is observed as glitter, especially in dark-dyed fabrics prepared from these yarns. When more than about 12% of the filaments in the multifilament textured yarn have cross-sections with a flattened surface or periphery greater than 10 microns in length, then fabrics produced from these textured yarns generally exhibit objectionable glitter. The amount of flattened filament surface or periphery is determinable by examining transverse cross-sectional slices of the yarn under a microscope.

The problem of reducing the size of the flat surface deformation sufficiently to overcome objectionable glitter is particularly serious with false-twist textured multifilament polyester textile yarns. When 6—6 nylon filaments are textured, this problem is more easily overcome since such straight chain aliphatic polyamides have better recovery than polyesters from large deformations as occur during false-twist texturing. The problem can also be more easily overcome by using filaments of a sufficiently low denier. However, fine denier filaments provide fabrics which are generally less desirable because they lack crispness and are too soft.

The severity of the problem is compounded when polyester yarns are drawn during the high temperature false-twist texturing operation, since draw-twist texturing generally results in even more severe deformation than false-twist texturing alone. The cross-sections of draw textured filaments which originally possessed round cross-sections are generally asymmetric with one axis several times longer than any other axis in the cross section. This deformation results from high compressional forces caused by simultaneous application of tension and torque to a heat softened filament during drawing. These factors cause greater lateral deformation of the filaments during attenuation. These factors would also be expected to increase deformation or distortion in draw-false-twist textured polyester yarns to such an extent that prior suggestions for obviating glitter in fully drawn yarns that are false-twist textured only would not be expected to be applicable.

SUMMARY OF THE INVENTION

Suitable polyester feed yarns for draw-texturing, wherein the yarn is drawn and false-twist textured in a unitary operation, have now been found. These feed yarns comprise partially oriented polyester filaments which have multilobal cross-sections having a total number (N) of 6–10 lobes which are essentially symmetric, of substantially equal length, and equispaced radially about the center of the filament cross-section. These partially oriented filaments are further characterized by the denier per filament of from 3.8 $R_o$ as minimum to maximum of (5.88M $-10+$N) $R_o$ at M=1.85, where M is the modification ratio and has a valve of 1.17–1.85 and $R_o$ is a nominal draw ratio of 1.2–5 for yarn suitable for draw-false-twist texturing. The value of $R_o$ depends on the extent of orientation of the feed yarn and is calculated from the percent break elongation ($E$) of the yarn using the expression $$R_o = \frac{1 + 0.01\,(E)}{1.35}.$$

The value of $R_o$ is preferably 1.2–2.

The invention provides draw-false-twist textured yarns comprising polyester filaments of recognizable multi-lobal cross-section having deviations from pure symmetry. The total number of lobes (N) is 6 to 10, the modification ratio (M) (determined on the feed yarn) is between 1.17 and 1.85, and the filament denier is from a minimum of about 3.8 to a maximum of about (5.88M $-10+N$) at $M = 1.85$. Less than 12% of the draw textured filaments have cross-sections with flattened periphery lengths greater than 10 microns. Because the amount of cross-section flattening is minimized, fabrics prepared from the textured yarns are free from objectionable glitter, particularly when dyed to a dark shade.

Preferred polyesters are poly(ethylene terephthalate) and an ethylene terephthalate copolyester containing about 2 mole percent of 5-sodium-sulfo-isophthalate units in the polymer chain. An octalobal cross-section is generally preferred.

BRIEF DESCRIPTION OF THE DRAWING

The single FIGURE of the drawing is a schematic representation of the cross-section of a hexalobal filament.

DETAILED DISCLOSURE

The term "partially oriented yarns " as used herein is intended to mean yarns which require additional orientation, as by drawing, in order to obtain fully useful textile properties. Such yarns may have break elongations in the range of about 62–575% and may be further oriented by drawing at draw ratios in the range 1.2–5. The term "paritally oriented yarns" is intended to include yarns which have been spun and paritally drawn in separately indentifiable steps as well as those which have been partially oriented by a single high-speed spinning step. The preferred partially oriented feed yarns of this invention are those which have break elongations in the range 70–180%.

The term "nominal draw ratio" as used herein to characterize the factor $R_o$ is that draw ratio at which the yarn can be draw-textured and from which the actual draw ratio can be determined depending on texturing conditions, the machine used and the properties desired in the textured product.

"Modification ratio" as used herein is defined with reference to FIG. 1 as $R_1/R_2$, where $R_1$ is the radius of circle X centered at C and circumscribed about the tips of the lobes Z and $R_2$ is the radius of circle Y centered at C and inscribed within the cross-section.

The term "essentially symmetric lobes" means that a line joining the lobe tip to center C will bisect the lobe area located above circle Y into two approximately equal areas which are essentially mirror images of one another.

By "lobes equispaced radially" is meant that the angle $\theta$ between a line joining any lobe tip to center C and the line joining the tip of the adjacent lobe is about the same for all adjacent lobes,i.e., approximately 360°/N. When the lobes are appreciably non-symmetrical and/or the angles $\theta$ are not approximately equal, "weak" points will be produced in the filament cross-section that will be more likely to produce a flat surface during texturing.

The term "equal length" when applied to lobes means that in a cross-sectional photomicrograph, a circle can be constructed which passes the margins of each of the tips of the lobes tangentially. Small variations from perfect symmetry generally occur in any spinning process due to such factors as non-uniform quenching or imperfect spinning orifices. It is to be understood that such variations are permissible provided that they are not of a sufficient extent to cause glitter in fabrics after texturing.

Upon examination of FIG. 1, it should be evident that filaments of a given number of lobes and modification ratio may have a variety of cross-sections. For example, while the tips of the lobes generally assume a rounded or circular configuration, the circle outlining the tip of the lobe may have a high or low tip radius, $r_1$, relative to the circumscribing radius, $R_1$, of the cross-section. In addition, the lobe angle, A, formed by two tangent lines laid at the points of inflection of curvature on each side of the lobe, may be either negative or positive. The lobe angle, A, is considered to be positive when the two tangent lines converge outside of the cross-section on the same side of the fiber as the lobe. A positive lobe angle, A, is indicated in FIG. 1. Lobe angles which are positive are especially preferred in the feed yarns of the invention, for lobes of this type are less likely to flatten during texturing.

The number of filament cross-sections with a flattened periphery greater than 10 microns in length is determined by microscopic examination of yarn cross-sections. The textured yarn is embedded in a suitable material and is cut transversely to expose a clear view of the filament ends. The length of the flattened periphery of the filament cross-sections may be determined by use of a calibrated eyepiece. Preferably, however, a thin transverse slice of the embedded yarn is prepared on a microtome and mounted on a microscope slide in an immersion oil. Photomicrographs are prepared showing the cross-section at a known magnification. The lengths of the flattened portions are then measured along a straight line with a scale on the photomicrograph. The measured values are then converted to actual dimensions using the magnification factor. To determine the percent of filaments having cross-sections with flattened periphery lengths greater than 10 microns, a cross-section of the entire yarn bundle is taken, examined, and the number of flattened peripheries greater than 10 microns divided by the total number of filaments examined is multiplied by 100.

The number of lobes of the filaments of the invention is in the range of 6 to 10. It is difficult to fabricate spinneret orifices having more than 10 radiating arms, and the interference with creation of flat surfaces is not effective in filaments having 5 lobes or less. On the other hand, if the filament denier is sufficiently low, i.e., less than 3.8 after drawing, it may be possible to produce glitter-free yarns from filaments having round or multi-lobal cross-sections after draw-false-twist texturing. However, low-denier filaments are less desirable because they provide fabrics which are too soft and lack crispness. In accordance with the present invention, a soft (uncrisp) hand is avoided by use of yarns in which the denier per filament after draw-false-twist texturing is at least about 3.8. In addition, as previously disclosed, the filaments must have the proper combination of modification ratio, number of lobes and denier per filament, at the draw ratio used for draw-twist texturing. The importance of these requirements will become further apparent from the examples.

The term polyester as used herein comprehends a substantially linear polymer of fiber-forming molecular weight comprising a series of predominantly carbon atom chains joined by a recurring carbonyloxy radical:

$$-\overset{\overset{\displaystyle O}{\|}}{C}-O-.$$

The term polyester is intended to include copolyesters, terpolyesters, and the like. Included, for example, are the polyesters disclosed in U.S. Pat. Nos. 2,465,319, 2,901,466 and 3,018,272. Polyesters having an intrinsic viscosity of at least about 0.3 are considered to be of fiber-forming molecular weight. Intrinsic viscosity has been defined in U.S. Pat. No. 3,776,886.

Intrinsic viscosities of polymers given in the examples are measured in the solvent consisting of 25 parts by volume of trifluoroacetic acid and 75 parts by volume of methylene chloride at 25° C.

In addition to terephthalic acid, dibasic acids useful in the preparation of copolyester yarn of this invention include isophthalic acid, sebacic acid, adipic acid, glutaric acid, bibenzoic acid, hexahydroterephthalic acid, ethylenedibenzoic acid, isopropylidinedibenzoic acid, 4,4'-dicarboxydiphenyl ether, 4,4'-dicarboxy-m-terephenyl, 2,6 and 2,7-naphthalenedicarboxylic acid and the like. Glycols useful in the preparation of copolyester yarns of this invention include the polymethylene glycols such as ethylene glycol and tetramethylene glycol and branched chain glycols such as 2,2-dimethyl-1,3-propanediol, 2,2-dimethyl-1,4-butanediol and the like. Also included are cis- and transhexahydro-p-xylylene glycol, bis-p-(2-hydroxyethoxy) benzene, bis-4,4' (beta-hydroxyethoxy)diphenyl, 1,4-dihydroxy(2·2²2)-bicyclo-octane, 2, 2-bis(4-hydroxyphenyl) propane, 2,2-bis (4-hydroxycyclohexyl) propane, 1,4-cyclohexane-diol, 4,4'-dihydroxybiphenyl, (bicyclohexyl)-4,4'-dimethanol and the like. Other polyester-forming reagents include bifunctional compounds such as beta-hydroxypivalic acid, hydroxyacetic acid, and the like.

The preferred polyesters used to prepare the yarns of the invention are poly(ethylene terephthalate) and a copolyester of poly(ethylene terephthalate) containing about 2 mole % of 5-sodium-sulfo-isophthalate units in the polymer chain. The copolyester, prepared as described in Griffing et al. U.S. Pat. No. 3,018,272, makes the filaments receptive to basic dyes.

Yarns of the proper denier can be prepared by melt-spinning. The denier of the melt-spun yarn is equal to the denier of an equivalent fully drawn yarn times the texturing draw ratio. Once one has determined the optimum draw-texturing draw ratio for the desired final denier, one can calculate the denier to be spun. The drawing operation is done as part of a unitary draw-texturing process as in Example I. In the unitary or "simultaneous" draw-texturing process, partially oriented yarn is passed through a nip roll or feed roll and then over a hot plate where it is drawn while in a twisted configuration. The filaments in the yarn pass from the hot plate to the spindle or twint-inserting means. As they exit the spindle, the filaments untwist and are passed over a second roller which, in a draw-texturing process, is frequently called the draw roll. After the yarn exits from this roller the tension is reduced as the yarn is fed to a second heater and/or wound up. The simultaneous imposition of drawing or attentuating forces and twisting forces with the application of heat subjects the filaments to tremendous deformation influences which would be expected to greatly proliferate flattened sections and increase the propensity of a draw-false-twist textured product to impart glitter to a fabric in spite of its initial multilobal cross-section.

As stated above, the partially oriented feed yarns for draw-false-twist texturing according to the invention must have a denier higher than the desired denier of the final textured yarn by a factor approximately equal to the overall draw ratio used in the draw-texturing operation.

While the actual draw ratio will vary according to the particular texturing machine used and the product desired, constraints of operability and quality, especially broken filaments in the textured yarn, often require draw ratios that give tensions up to 0.75 gram per denier in the post-spindle zone, preferably 0.35 to 0.75, calculated on the denier of the yarn at the draw roll; i.e., the feed denier divided by the mechanical draw ratio between the first delivery roll and the draw roll.

For high-speed spun partially oriented filaments, the factor $R_o$ is between 1.2 and 2. For slow-speed spun partially oriented yarns, $R_o$ may be as high as 5. The required denier per filament for partially oriented feed yarns is $3.8R_o$ or more depending on the value of M and N at a given $R_o$.

The paritally oriented feed yarns of this invention generally have a break elongation of about 62–575 percent, preferably 70–180 percent, as measured according to ASTM test D-2256-69, definition 3.3, option 4.1. Tenacity is also measured according to ASTM test D-2256-69, using definition 3.10, option 4.1. An Instron Tensile Testing Machine is used. The test sample is 5 inches (12.7 cm.) long, no twist is added, the crosshead speed is 10 inches/minute (25.4 cm./min.), the rate of attenuation is 200 percent/minute, and the chart speed is 5 inches/minute (12.7 cm./min.). Feed yarns having break elongations in the above preferred range can be draw textured without the difficulty of broken or fused filaments during normal string-up operations on conventional false-twist texturing machines.

The following examples illustrate the effect which different combinations of the number of lobes, denier per filament, draw ratio and modification ratio have on the severity of glitter from flattened surfaces on draw-false-twist textured yarns. Products which meet the specified limits of the invention all have acceptable glitter ratings.

EXAMPLE I

Poly(ethylene terephthalate) having an intrinsic viscosity of 0.64 is melt-spun at 280°–300° C. from a spinneret having 34 orifices consisting of eight slots 0.0089 cm. wide and 0.0285 cm. long arranged radially around a center point and intersecting at the center. After emerging from the spinneret, the filaments are quenched by a stream of air directed radially inward against the thread line. The denier per filament is adjusted by the relationship between extrusion rate and wind-up speed. The drawability, degree of molecular orientation, and modification ratio are adjusted by control of the quenching air temperature and of the quenching air speed in conjunction with wind-up speed. Partially oriented, 235 denier, 34-filament yarns are obtained which have a break elongation of 112% and a tenacity of 2.2 grams per denier (gpd). The filaments have octalobal cross-sections (N = 8) with essentially symmetric lobes of substantially equal length of equispaced radially around the centers of the filaments and positive lobe angles. The filaments also have a modification ratio M of 1.22 and a denier per filament of 6.9. A finish is applied which consists of an aqueous dispersion of 12% by weight of a polyoxyalkylene block copolymer, about 0.1% of a surface-active agent and a basic buffer. The block copolymer contains about 40% by weight of oxyethylene groups and 60% of oxy-1,2-propylene groups.

The paritally oriented yarns are then draw-textured on a conventional draw-texturing maching (ARCT-480 manufactured by Ateliers Roannais de Construction Textile) and set (second heater) under the conditions shown in Table I. The textured yarns are knit into fabrics, dyed a dark color, finished, and evaluated for glitter. Yarn properties are shown in Table I. All fabrics prepared for these yarns have acceptable glitter ratings. Four percent of the filaments of yarn 3 have a flattened periphery greater than 10 microns in length.

TABLE I

PROCESS AND PRODUCT DATA FOR EXAMPLE I

| | | Textured Yarn Properties | | | Texturing Conditions (ARCT-480) | | | | | |
|---|---|---|---|---|---|---|---|---|---|---|
| Color | Finish-% on Yarn | Den. | Ten. (g/d) | Elong. (%) | w/Cooling Zone | Turns/cm | Temp. of First Heater(° C) | Temp of Second Heater(° C) | RPM[4] X10$^{-3}$ | Draw Ratio |
| [1]Brown | 1.0 | 168 | 3.5 | 25 | No | 25.9 | 210° | 230° | 391 | 1.57X |

TABLE I-continued

| PROCESS AND PRODUCT DATA FOR EXAMPLE I | | | | | | | | | | |
|---|---|---|---|---|---|---|---|---|---|---|
| | | Textured Yarn Properties | | | Texturing Conditions (ARCT-480) | | | | | |
| Color | Finish-% on Yarn | Den. | Ten. (g/d) | Elong. (%) | w/Cooling Zone | Turns/cm | Temp. of First Heater(° C) | Temp of Second Heater(° C) | RPM[4] X10−3 | Draw Ratio |
| [2]Blue | 1.0 | 171 | 3.5 | 31 | No | 23.6 | 210° | 230° | 363 | 1.50X |
| [3]Green | 1.0 | 178 | 3.4 | 36 | Yes | 23.6 | 210° | 230° | 363 | 1.46X |

[1]3.5% Color Index disperse blue 64
2.0% Color Index disperse orange 25
[2]2.57% Color Index disperse yellow 54
0.80% Color Index disperse violet 27
8.00% Color Index disperse blue 7
[3]5.0% Color Index disperse blue 64
0.8% Color Index disperse blue 27
0.4% Color Index disperse orange 25
[4]"RPM" is revolutions per minute

EXAMPLE II

Poly(ethylene terephthalate) having a relative viscosity of 26.5 at 25° . in Fomal, which is 10/7 by weight phenol/trichlorophenol, equivalent to an intrinsic viscosity of about 0.65, is melt spun at 290° C. through a spinneret with 34 shaped orifices, each having ten equispaced radial arms 0.0076 cm wide by 0.061 cm long measured from the center outward. After suitable quenching the 256 denier/34 filament yarn is wound up at 3140 meters per minute (mpm) (calculated from roll rpm and and conversion factors). The finish is of the general type described in Cooley's U.S. Pat. No. 3,594,200, using 36.3 parts of the sodium salt of sulfated peanut oil, 27.5 parts of refined coconut oil, 1.9 parts of potassium hydroxide, 24.5 parts of the aromatized phosphate ester and 9.8 parts of soft hydrocarbon wax. The finish is applied during spinning to give a level of 0.6% weight of finish based on the weight of the yarn. The filaments have ten essentially symmetrical lobes of substantially equal length, equispaced radially about the center of the filaments, a modification ratio of 1.17, a tenacity of 2.8 gpd and a break elongation of 90%.

The yarn is draw-false-twist textured on a Lessona 555 texturing machine at 210,000 rpm spindle speed, 26.3 geared twists per cm (tpc) (23.6 real tpc), 1.64 draw ratio and 220° C. heater plate. Photomicrographs of cross sections of the textured yarn show that none of the filaments have flat sides greater than 10 $\mu$ in length.

The textured yarns are backwound with knitting oil applied and knit into a 274 grams per square meter (gpm$^2$) fabric on a 22-cut knitting machine. Fabrics are dyed a dark blue color using 7.2% by weight of color Index disperse violet 27 and 1.2% by weight of Color Index disperse blue 65 based on the weight of fiber and finished using normal scouring and heat-setting conditions. The resulting fabric when viewed in well-collimated light is free from the objectionable glitter that is found in similar fabrics made from textured yarns prepared from feed yarns having round cross-sections and about the same denier.

EXAMPLE III

Poly(ethylene terephthalate) having an intrinsic viscosity of 0.67 is spun at 290° C. through a spinneret with 34 shaped orifices each having eight equispaced radial arsm 0.0089 cm wide by 0.0407 cm long measured from the center outward. The filaments are quenched and wound up at 4115 mpm and a 191 denier 34 filament yarn is obtained. A finish consisting of a block copolymer of ethylene oxide and propylene oxide in which the central block is polyoxy-1,2-propylene having a number average molecular weight of 1750 which is condensed with ethylene oxide to a number average molecular weight of 2900 as the final polymer in which 40 weight percent is ethylene oxide and 60 weight percent is the propylene oxide block with buffering and anti-oxidant additives is applied at a level of 0.9% by weight of finish based on the weight of the yarn. The filaments have eight essentially symmetrical lobes of substantially equal length, equispaced radially about the center of the filaments, a modification ratio of 1.25, a tenacity of 2.8 gpd and a break elongation of 90%.

The yarn is false-twist textured on a Leesona 555 texturing machine at 300,000 rpm spindle speed, 26.7 geared tpc (25.7 real tpc), 1.28 draw ratio and 230° C. heater plate. Photomicrographs of cross-sections of the textured yarn show that 9% of the filaments have flat sides 10$\mu$ or greater in length.

The textured yarn is knitted into a single-knit tubing on a Lawson FAK with 54 guage head, 8/1 ratio, 10 meter setting and dyed a deep navy blue shade using 6% by weight of Color Index disperse blue 64, 1% by weight of Color Index disperse blue 27 and 1% by weight of Color Index disperse orange 21 based on the weight of the tubing. The resulting fabric when viewed in well-collimated light is free from objectionable glitter.

EXAMPLE IV

Poly(ethylene terephthalate) flake having an intrinsic viscosity of 0.62 is melt spun at 300° C. through a spinneret with 34 shaped orifices each having six equispaced radial arms 0.003 inches by 0.018 inches long measured from the center outward. The filaments are quenched and wound up at 3109 mpm. The resulting 34 filament yarn has a denier of 241. The finish of Example II is applied during spinning to give a level of 1.53% of finish based on the weight of the yarn. The filaments have six essentially symmetrical lobes of substantially equal length, equispaced radally about the center of the filaments, a modification ratio of 1.38, a tenacity of 2.2 gpd and a break elongation ov 143%.

The yarn is false-twist textured on a Lessona 570 texturing machine at 240,000 rpm spindle speed, 25.9 geared tpc (24.4 real tpc), 1.632 draw ratio and 215° C. first and second heater plate temperatures. Photomicrographs of cross-sections of the textured yarn show that 5.5% of the filaments have flat sides 10$\mu$ or greater in length.

The textured yarn is knit and dyed as in Example II. The resulting fabric when viewed in well-collimated light is free from the objectionable glitter that is found in similar fabrics made from textured yarns prepared from feed yarns having round cross-sections about the same denier.

EXAMPLE V

The polymer supply and conditions of Example IV are used except a spinneret with 34 shaped orifices each having eight equispaced radial arms 0.0076 cm wide by 0.0458 cm long is used to prepare a 239 denier 34 filament yarn. The yarn filaments have eight essentially symmetrical lobes of substantially equal length, equispaced radially about the center of the filaments and a modification ratio of 1.17. This yarn is textured and finished in the manner of Example IV. The break elongation of the yarn 134% and the tenacity of 2.25. Photomicrographs of cross-sections of the textured yarn show that 6% of the filaments have flat sides 10$\mu$ or greater in length.

The textured yarn is knit and dyed as in Example II. The resulting fabric is free from objectionable glitter when viewed in well-collimated light.

EXAMPLE VI

Polyester flake of ethylene glycol terephthalate containing 2 mole % sodium-sulfoisophthalate having an intrinsic viscosity of 0.49 is melt spun at 300° C through a spinneret having 34 shaped orifices, each consisting of eight slots 0.0076 cm wide by 0.0458 cm long radiating symmetrically outward from a common center. The extruded filaments are quenched with air about 21° C (70° F). The finish of Example III is applied to a level of 0.66% by weight of yarn. The yarn is forwarded at 3109 mpm and wound up at the same speed. The yarns have an intrinsic viscosity of 0.48, a total denier of 231 (6.8 denier per filament, a tenacity of 1.55 grams per denier, 120% elongation to break, and the individual filaments have a modification ratio of 1.26. The yarn so produced is simultaneously drawn and false-twist textured at 270,000 rpm spindle speed, 23.6 turns per cm twist, and 190° C heater temperature at a draw ratio 1.54. The textured yarn has a denier of 153, a tenacity of 2.2, an elongation of 19.3% and % flat sides > 10 $\mu$ (determined from cross sections of about 30 filaments of 650X magnification ) of 7. The yarn is knit into a single-feed tubing using a Lawson FAK knitter and dyed a dark brown shade. For comparison, a draw-twist textured poly(ethylene terephthalate) yarn made from initially round filaments of similar denier and count is dyed a similar shade. When examined in bright sunlight, the fabric made from the octalobal test yarns are free of objectionable glitter, whereas the fabric prepared from round cross section feed yarn has severe glitter.

Although the invention has been described in conderable detail in the foregoing, it is to be understood that such detail is solely for the purpose of illustration and that variation can be made therein by those skilled in the art without departing from the spirit and scope of the invention.

What is claimed is:

1. An improved partially oriented multifilament polyester yarn for draw-false-twist texturing composed of polyester filaments of multilobal cross-section characterized by a total number (N) of 6 to 10 essentially symmetric lobes of substantially equal length, equispaced radially about the center of the filament cross-section, a modification ratio (M) between 1.17 and 1.85 and a denier per filament of a minimum of $3.8R_o$ and a maximum of $(5.88M - 10 + N)\ R_o$ at $M = 1.85$, wherein $R_o$ is 1.25–5 and is equal to the ratio $$M = \frac{1 + 0.01\ (E)}{1.35}$$

in which $E$ is the break elongation of the partially oriented yarn.

2. The yarn of claim 1 wherein the polyester is poly(ethylene terephthalate).

3. The yarn of claim 1 wherein the polyester is an ethylene terephthalate copolyester containing about 2 mole percent of 5-sodium-sulfo-isophthalate units in the polymer chain.

4. The yarn of claim 1 wherein the polyester filaments have octalobal cross-sections.

5. The yarn of claim 1 wherein the polyester filaments have positive lobe angles.

6. The yarn of claim 1 wherein the break elongation (E) is 62 - 575 percent.

7. The polyester yarn of claim 6 wherein the break elongation (E) is about 70 - 180 percent.

8. The yarn of claim 1 wherein $R_o$ is 1.2 - 2.

* * * * *

Disclaimer 4,041,689.—*Patrick Joseph Duncan*, Hendersonville, Tenn., and *Francis Edward Scrivener, Jr.*, Chester, Va. MULTILOBAL POLYESTER YARN. Patent dated Aug. 16, 1977. Disclaimer filed Aug. 1, 1977, by the assignee, *E. I. du Pont de Nemours and Company.*

The term of this patent subsequent to Sept. 19, 1989 has been disclaimed. [*Official Gazette September 20, 1977.*]

UNITED STATES PATENT OFFICE

CERTIFICATE OF CORRECTION

PATENT NO. : 4,041,689

DATED : August 16, 1977

INVENTOR(S) : Patrick Joseph Duncan and Francis Edward Scrivener, Jr.

It is certified that error appears in the above-identified patent and that said Letters Patent are hereby corrected as shown below:

Column 1, line 25, "nolvelty" should be -- novelty --.

" 1, line 36, "In" should be -- in --.

Column 2, line 24, "the" should be -- a --.

" 2, line 26, "valve" should be -- value --.

Column 4, line 55, "yarn" should be -- yarns --.

Column 5, line 1, "$(2 \cdot 2^2 2)$" should be -- $(2 \cdot 2 \cdot 2)$ --.

" 5, line 27, "twint" should be -- twist --.

Column 7, line 19, "25°" should be -- 25°C. --.

" 7, line 33, after "0.6%" insert -- by --.

Column 8, line 48, after "inches" first occurrence, insert -- wide --.

" 8, line 55, "radally" should be -- radially --.

" 8, line 57, "ov" should be -- of --.

UNITED STATES PATENT OFFICE

CERTIFICATE OF CORRECTION

PATENT NO. : 4,041,689

DATED : August 16, 1977

INVENTOR(S) : Patrick Joseph Duncan and
Francis Edward Scrivener, Jr.

It is certified that error appears in the above-identified patent and that said Letters Patent are hereby corrected as shown below:

Column 9, line 14, after "yarn" insert -- is --.

Column 10, line 7, "conderable" should be
-- considerable --.

Column 10, line 10, "variation" should be
-- variations --.

Column 10, line 23, "1.25-5" should be -- 1.2-5 --.

" 10, line 25, delete "M = " from the formula.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*